US009027653B2

(12) United States Patent
Budler et al.

(10) Patent No.: US 9,027,653 B2
(45) Date of Patent: May 12, 2015

(54) SECONDARY SYSTEM AND METHOD FOR ACTIVATING A DOWN HOLE DEVICE

(71) Applicant: Halliburton Energy Services, Inc., Houston, TX (US)

(72) Inventors: Nicholas Frederick Budler, Duncan, OK (US); Frank Acosta, Duncan, OK (US); Kumaran Palanivel, Al Khobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 255 days.

(21) Appl. No.: 13/628,955

(22) Filed: Sep. 27, 2012

(65) Prior Publication Data

US 2014/0083713 A1 Mar. 27, 2014

(51) Int. Cl.

| | |
|---|---|
| ***E21B 34/06*** | (2006.01) |
| ***E21B 23/00*** | (2006.01) |
| ***E21B 23/04*** | (2006.01) |
| ***E21B 33/14*** | (2006.01) |
| ***E21B 34/14*** | (2006.01) |
| ***E21B 41/00*** | (2006.01) |

(52) U.S. Cl.

CPC ..... *E21B 23/00* (2013.01); *E21B 23/04* (2013.01); *E21B 33/14* (2013.01); *E21B 34/14* (2013.01); *E21B 41/00* (2013.01)

(58) Field of Classification Search

CPC ..... E21B 34/063; E21B 33/146; E21B 2034/007; E21B 21/103

USPC ..... 166/194, 318, 332.1, 334.1, 376, 373, 166/375, 285

See application file for complete search history.

(56) References Cited

U.S. PATENT DOCUMENTS 3,524,503 A 8/1970 Baker
6,293,342 B1 * 9/2001 McGarian et al. ..... 166/317

(Continued)

FOREIGN PATENT DOCUMENTS

WO 2014052404 A1 4/2014

OTHER PUBLICATIONS

International Search Report and Written Opinion for PCT/US2013/061600 dated Jan. 27, 2014.

*Primary Examiner* — Shane Bomar
*Assistant Examiner* — Kipp Wallace
(74) *Attorney, Agent, or Firm* — McDermott Will & Emery LLP; John W. Wustenberg

(57) ABSTRACT

Disclosed is a secondary system and method for initiating a down hole operation in a wellbore when a primary activation system fails. The primary activation system is configured to provide fluid communication between a first chamber and a second chamber in response to a primary activation operation. The secondary activation system includes a passageway between the first chamber and the second chamber, and a rupture member positioned in the passageway. The rupture member has a threshold pressure differential at which the rupture member ruptures to afford fluid communication between the first chamber and the second chamber to thereby initiate the down hole operation if the primary activation system fails. The primary activation operation may be configured to move a trigger member to initiate the down hole operation, whereas the secondary activation operation may be configured to initiate the down hole operation without moving the trigger member.

17 Claims, 2 Drawing Sheets

(56) References Cited

U.S. PATENT DOCUMENTS

| | | | | |
|---|---|---|---|---|
| 7,021,389 | B2 | 4/2006 | Bishop et al. | |
| 2003/0155118 | A1* | 8/2003 | Sonnier et al. | 166/206 |
| 2006/0196678 | A1* | 9/2006 | Connell et al. | 166/380 |
| 2007/0119599 | A1* | 5/2007 | Chavers et al. | 166/386 |
| 2009/0032255 | A1 | 2/2009 | Surjaatmadja et al. | |
| 2009/0095486 | A1* | 4/2009 | Williamson, Jr. | 166/373 |
| 2011/0315380 | A1 | 12/2011 | Sherman | |
| 2012/0073819 | A1 | 3/2012 | Richard et al. | |
| 2012/0181032 | A1 | 7/2012 | Naedler et al. | |
| 2012/0181732 | A1* | 7/2012 | Stephenson et al. | 264/564 |
| 2014/0116721 | A1* | 5/2014 | Hofman et al. | 166/373 |

* cited by examiner

SECONDARY SYSTEM AND METHOD FOR ACTIVATING A DOWN HOLE DEVICE

BACKGROUND

The present invention relates to systems and methods used in down hole applications. More particularly, the present invention relates to a secondary or contingency system for initiating a down hole operation such as opening a cementer or setting a down hole tool when a primary system for initiating the down hole operation fails.

In the course of treating and preparing a subterranean well for production, down hole tools, such as well packers, are commonly run into the well on a tubular conveyance such as a work string, casing string, or production tubing. The purpose of the well packer is not only to support the production tubing and other completion equipment, such as sand control assemblies adjacent to a producing formation, but also to seal the annulus between the outside of the tubular conveyance and the inside of the well casing or the wellbore itself. As a result, the movement of fluids through the annulus and past the deployed location of the packer is substantially prevented.

Well packers are designed to be set using a variety of methods, including electronics, pressure-setting, mechanical shifting, and the like. Although the specific reasons can vary, these well packers are each subject to failure or malfunction. The time and effort required to deal with such failures can be extremely costly.

In addition to the setting of well packers, cementing operations often involve the shifting of one or more internal sleeves to open or otherwise expose ports or passageways in the casing string to allow cement slurry to flow from the interior of the casing into the annulus between the casing wellbore. As with the setting of a well packer, when a cementing operation fails, costly time and effort may be required to send specialized plugs or other machinery down the well to complete the operation.

SUMMARY

The present invention relates to systems and methods used in down hole applications. More particularly, the present invention relates to a secondary or contingency system for initiating a down hole operation such as opening a cementer or setting a down hole tool when a primary system for initiating the down hole operation fails.

In some embodiments, a system for initiating a down hole operation in a wellbore, the system includes a primary activation system including a moveable member that is movable to open a port to afford fluid communication between a first chamber and a second chamber to thereby initiate the down hole operation. The system also includes a secondary activation system for performing the down hole operation when the primary activation system fails. The secondary activation system includes a passageway between the first chamber and the second chamber, and a rupture member positioned in the passageway. The rupture member has a first side exposed to the first chamber, a second side exposed to the second chamber, and a threshold pressure differential between the first side and the second side at which the rupture member ruptures to afford fluid communication between the first chamber and the second chamber to thereby initiate the down hole operation.

In other embodiments, a system for initiating a down hole operation in a wellbore includes a body and a rupture member. The body includes an inner surface, an outer surface, a first end, and a second end. The body defines a passageway extending between the inner surface and the outer surface, and at least a portion of the body is configured to move during a primary activation operation to initiate the down hole operation. The rupture member is positioned in the passageway and configured to initiate the down hole operation when the primary activation operation fails. The rupture member has a threshold pressure differential at which the rupture member ruptures to permit fluid flow through the passageway and to thereby initiate the down hole operation.

In still other embodiments, a method for initiating a down hole operation in a wellbore includes positioning a trigger member in the wellbore and performing a primary activation operation configured to move the trigger member from a first position to a second position to initiate the down hole operation. If the primary activation operation fails, a secondary activation operation is performed that initiates the down hole operation without moving the trigger member.

Features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods used in down hole applications. More particularly, the present invention relates to a secondary or contingency system for initiating a down hole operation such as opening a cementer or setting a down hole tool when a primary system for initiating the down hole operation fails.

Systems and methods disclosed herein can be configured as secondary, backup, or contingency systems for performing or initiating various down hole operations, such as setting a down hole tool, cementing, and the like. Other applications will be readily apparent to those skilled in the art. Systems and methods are disclosed that permit the down hole operation to be initiated or performed when the primary system or method for initiating or performing the down hole operation fails to function as desired. In some embodiments, the disclosed systems and methods operate using hydraulic pressure and without the use of electronics, signaling, or mechanical means. Some disclosed systems and methods take advantage of a pressure-sensitive rupture member configured to rupture when subjected to a predetermined pressure differential and to thereby permit fluid communication between two chambers that previously had been in substantial fluid isolation. For example, the pressure-sensitive rupture member may be positioned to isolate the interior of a well base pipe from the annular space between the outer surface of the base pipe and the inner surface of the wellbore.

Moreover, the pressure-sensitive rupture member may be configured to rupture in response to a pressure differential that is greater than a pressure differential associated with operation of the primary activation system for initiating the down hole operation. The disclosed systems and methods therefore provide a secondary, backup, or contingency system for initiating a down hole operation that can reduce time and effort that might otherwise be lost when the primary system for initiating the down hole operation fails. To facilitate a better understanding of the present invention, the following examples are given. It should be noted that the examples provided are not to be read as limiting or defining the scope of the invention.

Figure 1:
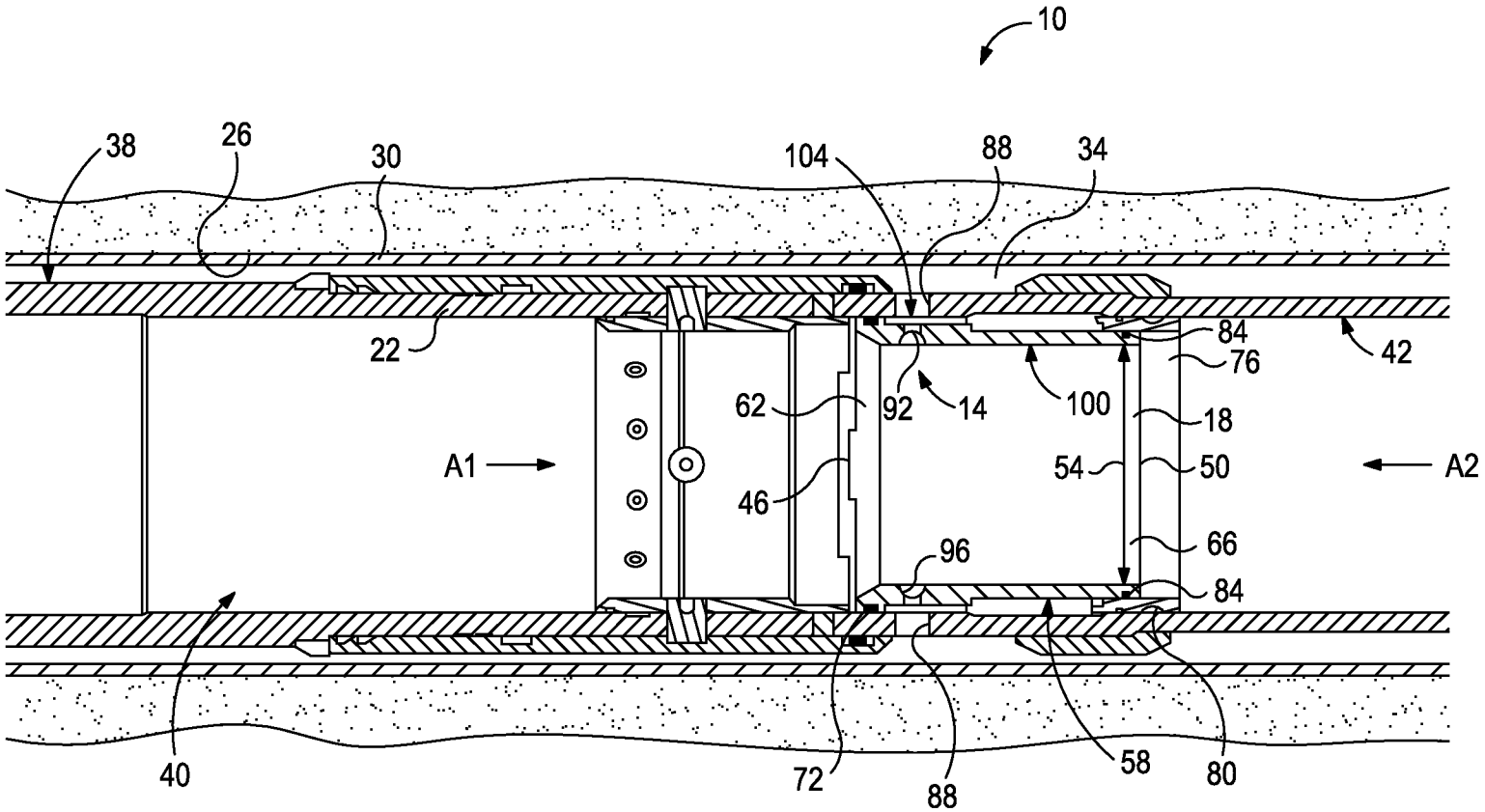
FIG. 1 illustrates a cross-sectional view of a portion of a base pipe and accompanying primary and secondary activation system, according to one or more embodiments disclosed.

Referring to FIG. 1, illustrated is a cross-sectional view of a down hole assembly 10 that includes an exemplary secondary activation system 14 for performing a down hole operation, according to one or more embodiments. In the illustrated configuration, the secondary activation system 14 is configured to initiate operation of a multi-stage cementer. However, those skilled in the art will appreciate and recognize that the secondary system 14 may also be configured for use in other applications, such as the setting of various down hole tools, including, for example, a casing annulus isolation tool, a multistage tool, formation packer shoes or collars, combinations thereof, or any other down hole tool.

In the illustrated construction, the secondary activation system 14 includes a substantially annular sleeve 18 that is moveably positioned within a base pipe 22. The base pipe 22 extends within a wellbore 26 that has been drilled into the Earth's surface to penetrate various earth strata containing, for example, one or more hydrocarbon formations. It will be appreciated that the system 14 is not limited to use with any specific type of well, but may be used in all types, such as vertical wells, horizontal wells, multilateral (e.g., slanted) wells, combinations thereof, and the like. An optional casing 30 may be disposed within an annulus 34 that is defined between an outer surface 38 of the base pipe 22 and the wellbore 26. The optional casing 30 forms a protective lining within the wellbore 26 and may be made from materials such as metals, plastics, composites, or the like. In some embodiments, the casing 30 may be expanded or unexpanded as part of an installation procedure and/or may be segmented or continuous. In some embodiments, the base pipe 22 may be run within another, previously set casing string, thereby providing one or more concentric casing strings with annular spaces therebetween.

The base pipe 22 may include one or more tubular joints, having metal-to-metal threaded connections or otherwise threadedly joined to form a tubing string. In other embodiments, the base pipe 22 may form a portion of a coiled tubing. The base pipe 22 may also be defined in whole or in part by other types of down hole equipment. The base pipe 22 may have a generally tubular shape and may define an interior 40 surrounded by an inner surface 42. However, other configurations may be suitable, depending on particular conditions and circumstances. For example, some configurations of the base pipe 22 may include offset bores, sidepockets, etc. The base pipe 22 may include portions formed of a non-uniform construction, for example, a joint of tubing having compartments, cavities or other components therein or thereon. Moreover, the base pipe 22 may be formed of various components, including, but not limited to, a joint casing, a coupling, a lower shoe, a crossover component, or any other component known to those skilled in the art. In some embodiments, various elements may be joined via metal-to-metal threaded connections, welded, or otherwise joined to form the base pipe 22. When formed from casing threads with metal-to-metal seals, the base pipe 22 may omit elastomeric or other materials subject to aging, and/or attack by environmental chemicals or conditions.

The annular sleeve 18 is configured as a pressure-sensitive moveable trigger that functions as a primary activation system for initiating a down hole operation in the wellbore. In this regard, the sleeve 18 includes a first end 46 having a first area and an opposite second end 50 having a second area that is smaller than the first area. The first and second areas may be axially projected areas obtained by calculating the area of the apparent shape of the sleeve 18 when viewed in the direction of arrow A1 for the first area and in the direction of arrow A2 for the second area.

In the illustrated embodiment, the sleeve 18 includes a substantially constant inner diameter 54 and a stepped outer diameter 58 such that a first portion 62 of the sleeve 18 adjacent the first end 46 may have a greater outer diameter and wall thickness than a second portion 66 of the sleeve 18 adjacent the second end 50. Although other configurations are possible, the stepped outer diameter of the sleeve 18 contributes to the resulting difference between the first area and the second area.

In the illustrated embodiment, the outer diameter of the first portion 62 of the sleeve 18 may engage the inner surface 42 of the base pipe 22, and may include a seal 72 positioned therebetween. Also in the illustrated embodiment, the outer diameter of the second portion 66 of the sleeve 18 may engage a substantially annular collar 76 that may be fixed with respect to the base pipe 22 such that the sleeve 18 is received by and axially slidable within the collar 76. An additional seal 84 may also be provided between the sleeve 18 and the annular collar 76. As shown, the collar 76 is located in an annular space between the second portion 66 of the sleeve 18 and the inner surface 42 of the base pipe 22. One or both of the collar 76 and the sleeve 18 may include additional seals, such as the seal 80, for sealing the engaging surfaces of the collar 76, the sleeve 18, and the base pipe 22.

The primary activation system for initiating a down hole operation in the wellbore may also include a force-sensitive and releasable latch for preventing substantial movement of the sleeve 18 with respect to the base pipe 22 until a predetermined force is applied to the sleeve 18. For example, the primary activation system may include a latch in the form of the seals 72 and 84, which may be configured to limit via friction movement of the sleeve 18 with respect to the base pipe 22 until a predetermined force is applied to the sleeve 18. In other embodiments, the primary activation system may include one or more shear pins (not shown) having a first end that is fixed with respect to the base pipe 22 and a second end that is fixed with respect to the sleeve 18. In still other embodiments, a shear lip or other force-sensitive and releasable securing elements may also or alternatively be provided to prevent substantial movement of the sleeve 18 with respect to the base pipe 22 until a predetermined force is applied to the sleeve 18.

Figure 2:
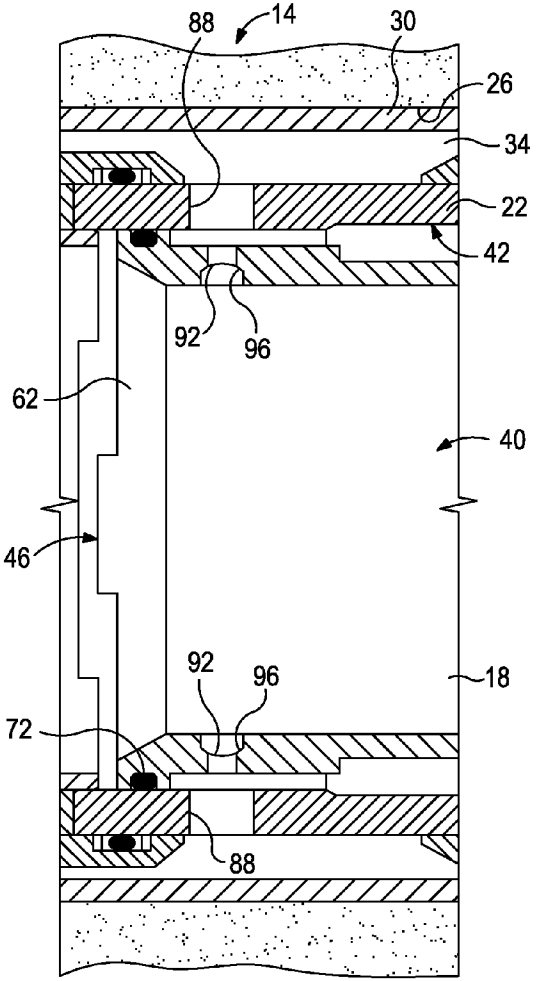
FIG. 2 illustrates an enlarged view of a portion of the activation system shown in FIG. 1 in an unactivated position.

Referring also to FIG. 2, one or more ports 88 extend through the base pipe 22 and/or through other system components for providing fluid communication between a first chamber, which in the illustrated configuration includes the interior 40 of the base pipe 22 and a second chamber, which in the illustrated configuration includes the annulus 34. In other configurations, the first chamber and the second chamber may be parts of different down hole components. For example, the first chamber may be a chamber that forms a portion of a down hole tool activation assembly (not shown), such as a chamber for setting an annular packer. The sleeve 18 is arranged so that when the sleeve 18 is in a first position (as shown in the Figures), the sleeve 18 blocks the ports 88 and thereby prevents substantial fluid communication between the interior 40 (first chamber) and the annulus 34 (second chamber). As discussed below, during operation of the primary activation system, the sleeve 18 is moveable to a second position (e.g., shifted to the right in the Figures) to open the ports 88 and thereby allow fluid communication between the interior 40 and the annulus 34 by way of the ports 88.

To operate the primary activation system, a shutoff plug (not shown), such as a ball, dart, or other blanking device, is landed down hole of the sleeve 18 such that the pressure in the interior 40 of the base pipe 22 can be increased in a controlled manner. Pressure in the interior creates a force differential on the sleeve 18 that tends to move the sleeve 18 axially toward the second end 50 (e.g., in the direction of the arrow A1). More specifically, because the second end 50 has a smaller area than the first end 46, the pressure in the interior 40 creates a greater force on the first end 46 than the second end 50. The resulting force acting on the sleeve 18 is an axial force that is substantially equal to the pressure in the interior multiplied by the difference between the first area and the second area. Accordingly, the force on the sleeve 18 is proportional to the pressure in the interior 40, and as the pressure in the interior increases, so does the force on the sleeve 18.

As discussed above, the releasable latch, which in the illustrated embodiment includes seals 72, 84, prevents substantial axial movement of the sleeve 18. The latch is configured to release, e.g., the seals 72, 84 are configured to slip, in response to pressurization of the interior 40 of the base pipe 22 to a predetermined actuation pressure, which in turn applies a predetermined axial force to the sleeve 18. When the primary activation system operates properly, the seals 72, 84 slip and the sleeve 18 moves axially along the base pipe 22 from the first position to the second position when the pressure in the interior 40 reaches the actuation pressure. Movement of the sleeve 18 to the second position opens the ports 88 and allows fluid communication between the interior 40 and the annulus 34. During a cementing operation, this opening of the ports 88 allows cement to flow from the interior 40, through the ports 88, and into the annulus 34.

For a variety of reasons, the primary activation system is not 100% reliable. In some instances, pressurizing the interior 40 to the actuation pressure does not move the sleeve 18 from the first position to the second position as desired. As a result, the ports 88 may remain substantially or entirely blocked and fluid communication between the interior 40 and the annulus 34 may therefore remain substantially prevented. It should be appreciated that the illustrated pressure-activated primary activation system with a moveable sleeve 18 is just one example of a primary activation system for performing or initiating a down hole operation. Other activation systems may include electronic motors or actuators and/or different configurations of moveable and non-moveable components for performing a desired task.

Regardless of the specific configuration of the primary activation system, embodiments of the secondary activation system 14 can be used to perform or initiate a desired down hole operation when the primary activation system fails or is otherwise inoperable. In the illustrated configuration, the secondary activation system 14 may include at least one rupture member 92 positioned in a passageway 96 that extends through the sleeve 18. The passageway 96 may extend from an inner surface 100 to an outer surface 104 of the sleeve 18. The inner surface 100 of the sleeve may be exposed to the interior 40 of the base pipe 22, and the outer surface 104 may face the inner surface 42 of the base pipe 22, including the port 88. The sleeve 18 may include a plurality of passageways 96, and each passageway 96 may receive or otherwise have arranged therein a respective rupture member 92. In some configurations, the sleeve 18 is oriented in the base pipe 22 such that at least one of the passageways 96 is substantially aligned with a corresponding one of the ports 88 in the base pipe 22.

In some embodiments, the rupture member 92 may rupture when subjected to a predetermined threshold pressure differential, and rupturing of the rupture member 92 may in turn establish fluid communication between the interior 40 of the base pipe 22 and the annulus 34 by way of the passageway 96 and the port 88, thereby initiating the down hole operation. The rupture member 92 may be or include, among other things, a burst disk, an elastomeric seal, a metal seal, a plate having an area of reduced cross section, a pivoting member held in a closed position by shear pins designed to fail in response to a predetermined shear load, an engineered component having built-in stress risers of a particular configuration, and/or substantially any other component that is specifically designed to rupture or fail in a controlled manner when subjected to a predetermined threshold pressure differential. The rupture member 92 may be configured as a one-way rupture member that only ruptures when elevated pressure is applied to a specific side of the rupture member 92. The rupture member 92 functions substantially as a seal between isolated chambers only until a pressure differential between the isolated chambers reaches the predetermined threshold value, at which point the rupture member fails, bursts, or otherwise opens to allow fluid to flow from the chamber at higher pressure into the chamber at lower pressure. The specific size, type, and configuration of the rupture member 92 generally is chosen so the rupture member 92 will rupture at a desired pressure differential.

In the illustrated configuration, the rupture member 92 is exposed to the interior 40 of the base pipe 22 and to the annulus 34 by way of the port 88. More specifically, a first side of the rupture member 92 is exposed to the interior 40, and a second side of the rupture member 92 is exposed to the annulus 34 due to the open fluid communication provided between the annulus and the rupture member 92 by the port 88 in the base pipe 22. When intact, the rupture member 92 delimits the interior 40 from the annulus 34. Accordingly, the rupture member 92 is located in the passageway 96 and acts as a seal between the interior 40 and the annulus when the rupture member 92 is intact.

The rupture member 92 is configured or selected such that the threshold pressure differential at which the rupture member 92 ruptures is greater than a pressure differential across the rupture member 92 when the interior 40 of the base pipe 22 is pressurized to the activation pressure associated with the primary activation system. In this way, during attempts to operate the primary activation system, for example, by pressurizing the interior 40 to the activation pressure to move the sleeve 18 from the first position to the second position, the rupture member or members 92 remain intact. If the primary activation system fails, e.g., if the sleeve 18 fails to move as desired, an operator can further pressurize the interior 40 until the threshold pressure differential is reached and the rupture member 92 ruptures. Once the rupture member 92 ruptures, fluid communication will be provided from the interior 40, through the passageway 96, through the port 88, and into the annulus, thereby initiating the down hole operation. Accordingly, when the primary activation system fails because the sleeve 18 or other trigger member does not move or otherwise function as desired, the secondary activation system allows for initiation of the down hole operation without moving the sleeve 18.

Figure 3:
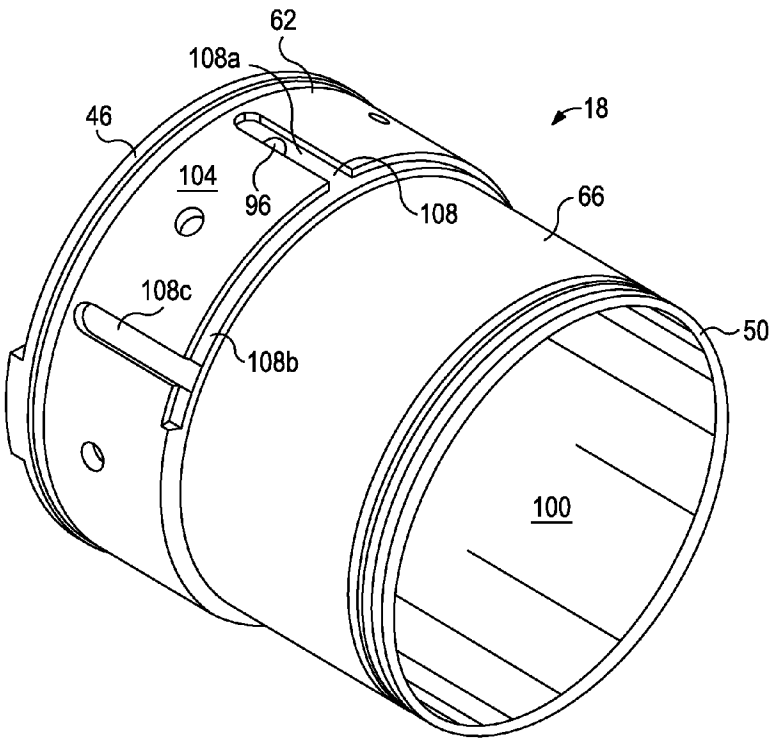
FIG. 3 is a perspective view an actuation sleeve of the activation system shown in FIG. 1.

Referring also to FIG. 3, some configurations of the sleeve 18 include one or more channels 108 that communicate with one or more of the passageways 96. The channels 108 can reduce the number of rupture members 92 utilized on a given sleeve 18 by communicating the passageways 96 in the sleeve 18 with more than one port 88 in the base pipe 22. As shown in FIG. 2, the sleeve 18 can be oriented such that at least some of the passageways 96 are substantially aligned with a corresponding one of the ports 88. However, the base pipe 22 may include several ports 88 circumferentially spaced about the base pipe 22. Rather than having a passageway 96 and corresponding rupture member 92 aligned with each port 88, the channels 108 can be formed on or in the sleeve 18 such that fluid flow through one passageway 96 can be routed to more than one port 88.

In the exemplary configuration of FIG. 3, a channel 108 includes an axially extending portion 108*a* that intersects and communicates with one of the passageways 96 formed in the sleeve 18. The axially extending portion 108*a* extends away from the passageway 96 and intersects a circumferentially extending portion 108*b* of the channel 108. The circumferentially extending portion of the channel 108 extends along a portion of the sleeve 18 and intersects another axially extending portion 108*c*. As shown, the illustrated axially extending portion 108*c* does not communicate or intersect with a passageway 96, but rather is positioned for alignment with one of the ports (not shown) on the base pipe 22. In this way, fluid flowing through the passageway 96 shown in FIG. 3 can be communicated to a first port 88 that is substantially aligned with the passageway 96 as well as to a second port 88 that is aligned with the axially extending channel portion 108*c*. Of course, the channel 108 can be configured to provide fluid communication to several ports 88, and several channels 108 can be provided to accommodate various configurations of passageways 96 and ports 88.

In the illustrated configuration, the channel 108 is formed as a recess in the outer surface 104 of the sleeve 18. In other configurations the channel 108 can be formed as a closed channel or bore through the sleeve 18 or through other components included in one or both of the first and second activation systems. Regardless of the specific configuration, the channel or channels 108 function such that, when the rupture member 92 ruptures, fluid from the interior 40 can flow through the channels 108 to those ports 88 in the base pipe 22 that are not necessarily aligned with one of the passageways 96 in the sleeve 18.

In the foregoing description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A system for initiating a down hole operation in a wellbore, the system comprising:

a primary activation system including a moveable member that is movable to open a port that provides fluid communication between a first chamber and a second chamber and thereby initiate the down hole operation; and a secondary activation system for performing the down hole operation when the primary activation system fails, the secondary activation system including a passageway defined in the moveable member and extending between the first and second chambers, and a rupture member positioned in the passageway, the rupture member having a first side exposed to the first chamber a second side exposed to the second chamber, wherein, upon experiencing a threshold pressure differential between the first side and the second side, the rupture member ruptures to afford fluid communication between the first chamber and the second chamber to thereby initiate the down hole operation.

2. The system of claim 1, further comprising a base pipe positioned in the wellbore, the first chamber being an interior of the base pipe and the second chamber being defined outside of the base pipe, and wherein the port is defined in the base pipe.

3. The system of claim 2, wherein the base pipe defines a second port communicating with the second chamber, and wherein the secondary activation system includes a channel extending between the passageway and the second port.

4. The system of claim 1, wherein the moveable member includes an annular sleeve having an inner surface exposed to the first chamber and an outer surface facing the port, the passageway extending between the inner and outer surfaces.

5. The system of claim 1, wherein the moveable member is configured for movement from a first position that blocks the port to a second position that opens the port in response to pressurization of the first chamber to an activation pressure, and wherein, when the primary activation system fails, the moveable member fails to move from the first position to the second position in response to the first chamber being pressurized to the activation pressure.

6. The system of claim 5, wherein an activation pressure differential between the first side and the second side of the rupture member and associated with the activation pressure is less than the threshold pressure differential.

7. The system of claim 1, wherein the passageway communicates with the second chamber through the port.

8. A system for initiating a down hole operation in a wellbore, the system comprising:

an annular sleeve having an inner surface, an outer surface, a first end, and a second end, the annular sleeve defining a passageway extending between the inner surface and the outer surface, wherein at least a portion of the annular sleeve is configured to move during a primary activation operation to initiate the down hole operation; and a rupture member positioned in the passageway and configured to initiate the down hole operation when the primary activation operation fails, the rupture member having a threshold pressure differential at which the rupture member ruptures to permit fluid flow through the passageway and thereby initiate the down hole operation, wherein at least one channel is defined in the annular sleeve and extends circumferentially around at least a portion of the annular sleeve, the at least one channel being in fluid communication with the passageway.

9. The system of claim 8, wherein the entire annular sleeve is configured for movement during the primary activation operation.

10. The system of claim 9, wherein the first end includes an axially projected first area that is greater than an axially projected second area of the second end, and wherein the primary activation operation includes subjecting the annular sleeve to an activation pressure configured to move the annular sleeve axially within the wellbore, and wherein the primary activation operation fails when the annular sleeve fails to move axially when subjected to the first activation pressure.

11. The system of claim 10, wherein the threshold pressure differential is greater than an activation pressure differential across the rupture member and associated with the activation pressure.

12. The system of claim 8, wherein the at least one channel is formed as a recess in an outer surface of the annular sleeve.

13. The system of claim 8, wherein the at least one channel includes a first portion extending circumferentially around at least a portion of the annular sleeve and a second portion extending axially between the passageway and the first portion.

14. A method for initiating a down hole operation in a wellbore, the method comprising:

positioning an annular sleeve in the wellbore as arranged within a base pipe having one or more ports defined therein to facilitate fluid communication between an interior of the base pipe and an annulus surrounding the base pipe;

performing a primary activation operation configured to move the annular sleeve from a first position, where the annular sleeve blocks the one or more ports, to a second position, where the one or more ports are exposed to initiate the down hole operation; and when the primary activation operation fails, performing a secondary activation operation that initiates the down hole operation without moving the annular sleeve, wherein the secondary activation operation includes rupturing a rupture member positioned within a passageway defined in the annular sleeve and extending between the interior of the base pipe and the annulus, wherein the rupture member has a first side exposed to the interior, a second side exposed to the annulus.

15. The method of claim 14, wherein performing the primary activation operation comprises increasing a pressure within the interior of the base pipe to an activation pressure, the annular sleeve being configured to move to the second position upon being subjected to the activation pressure.

16. The method of claim 15, wherein performing the secondary activation operation includes increasing the pressure in the interior of the base pipe to a threshold pressure that is greater than the activation pressure.

17. The method of claim 14, wherein initiating the down hole operation further comprises establishing fluid communication between the interior of the base pipe and the annulus.

* * * * *